US005614266A

United States Patent [19]

Cox et al.

[11] Patent Number: 5,614,266

[45] Date of Patent: Mar. 25, 1997

[54] CONTINUOUS STRIP COATING CONTROL METHODS

[75] Inventors: Timothy L. Cox, Weirton; John L. Loth, Morgantown, both of W. Va.; Anthony J. Santilli, Steubenville, Ohio; Howard Snyder, Coraopolis; Walter A. Wilson, Pittsburgh, both of Pa.

[73] Assignee: Weirton Steel Corporation, Weirton, W. Va.

[21] Appl. No.: 310,422

[22] Filed: Sep. 22, 1994

Related U.S. Application Data

[62] Division of Ser. No. 990,691, Dec. 15, 1992, Pat. No. 5,401,317, which is a continuation of Ser. No. 862,605, Apr. 1, 1992, abandoned.

[51] Int. Cl.[6] ..... B05D 1/18

[52] U.S. Cl. ..... 427/431; 427/9; 427/348; 427/349

[58] Field of Search ..... 427/348, 349, 427/9, 431; 118/63, 68, 665, 712

[56] References Cited

U.S. PATENT DOCUMENTS 4,524,716 6/1985 Mueller ..... 118/665

5,074,242 12/1991 Bricmont ..... 427/348

*Primary Examiner*—Shrive Beck
*Assistant Examiner*—David M. Maiorana
*Attorney, Agent, or Firm*—Shanley and Baker

[57] ABSTRACT

A coating control system is provided enabling continuous operations, free of interruption for coating control purposes, while achieving desired coating weight and thickness profile for the various gages, widths and coating specifications encountered on a given continuous strip production line. In each of a pair of elongated pneumatic dies, a pressurized gas jet is controllably shaped and directed by flow-control means internally-mounted of each pneumatic die to impinge against its respective substrate coated surface with its major directional component of force being controlled to be perpendicularly transverse to the travel path of the coated strip across its full width. Adjustment of such internally-mounted means is coordinated with control of gas pressure supply and/or adjustment of die positioning means to maintain desired coating weight and coating profile across the width of the strip. Pneumatic and other crown-control measures of the invention are exercised along the centerline of the of the strip enabling production of continuous-strip galvanized steel product having improved tracking and handling properties.

7 Claims, 8 Drawing Sheets

FIG. 7
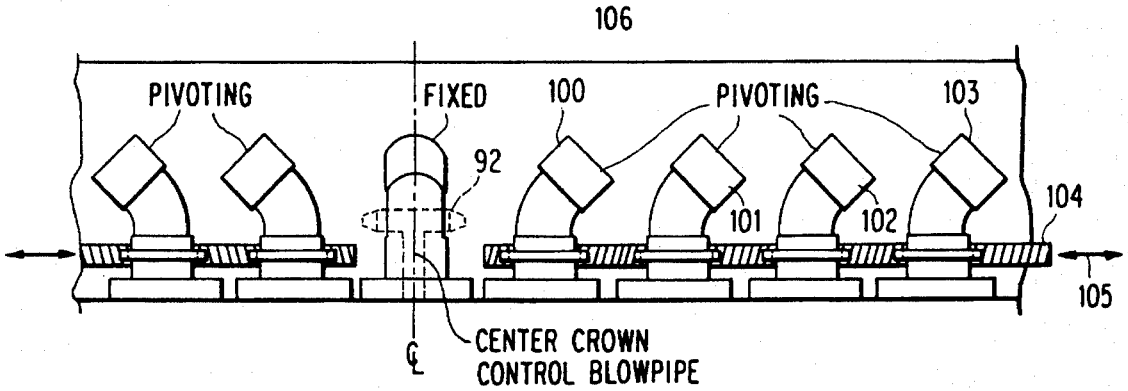
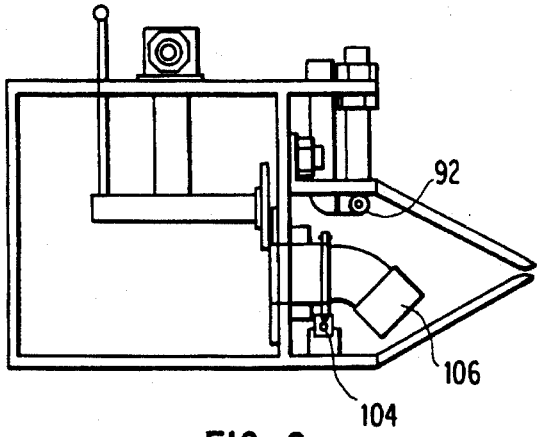
FIG. 8

FIG. 9
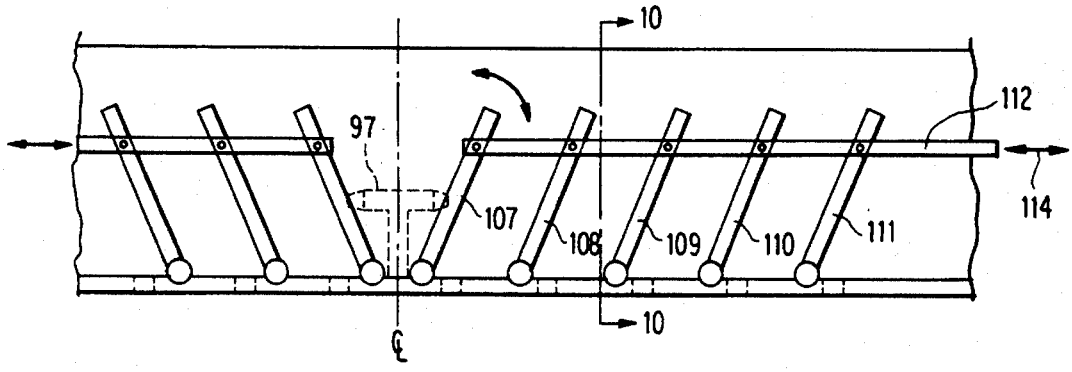
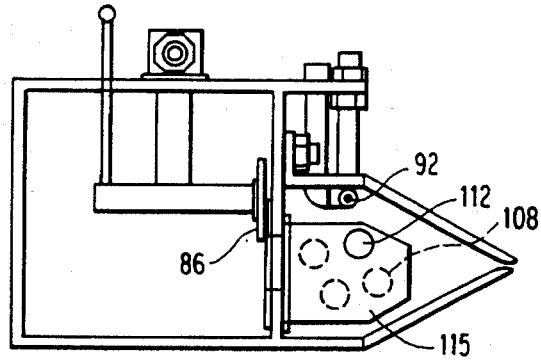
FIG. 10

FIG. 11
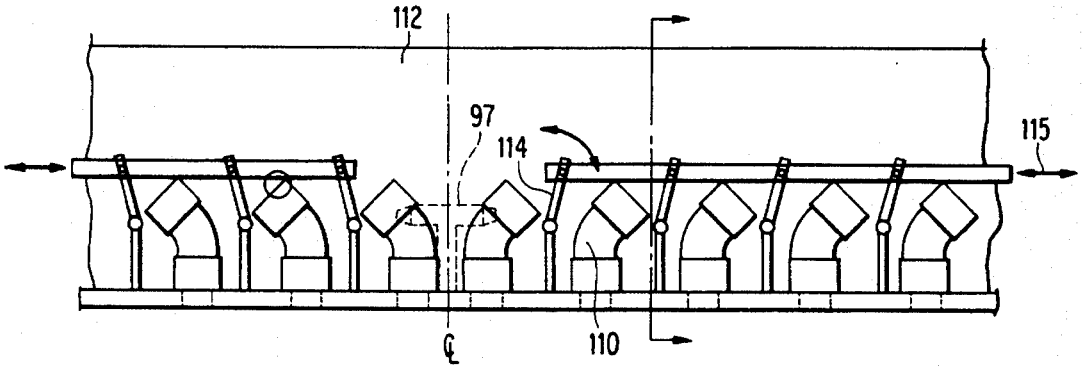
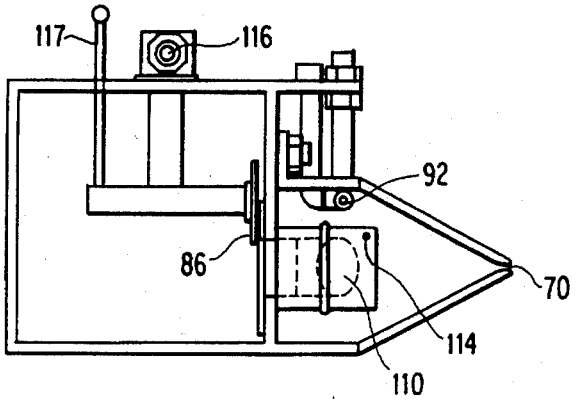
FIG. 12

FIG. 13
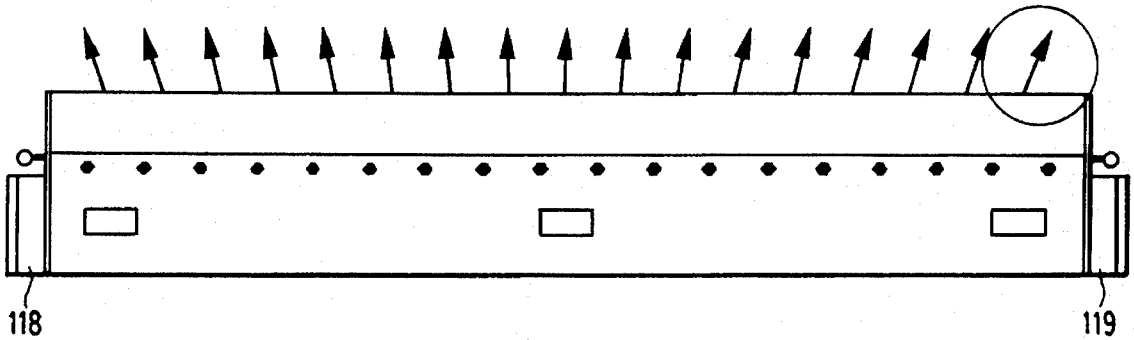
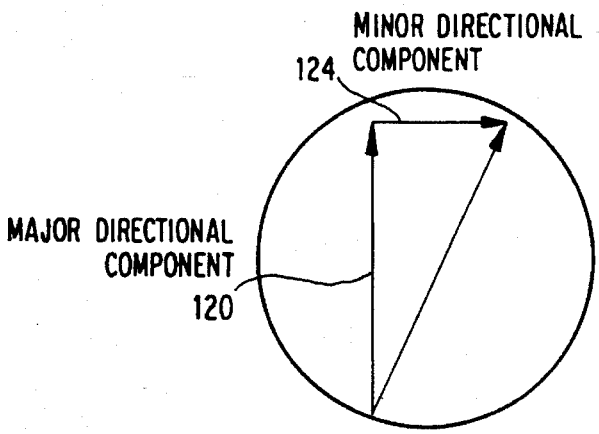
FIG. 14

CONTINUOUS STRIP COATING CONTROL METHODS

This is a, division of application Ser. No. 07/990,691, filed Dec. 15,1992, now U.S. Pat. No. 5,401,317 the entire disclosure of which is incorporated herein by reference which is a continuation of application Ser. No. 07/862,605 filed Apr. 1, 1992 now abandoned.

This invention is concerned with continuous coating of flat-rolled sheet metal, for example, hot-dip galvanizing of continuous-strip steel as it is moved in the direction of its length with molten metal in excess of desired coating weight adhering to both of its coated surfaces.

More particularly, this invention is concerned with a pneumatic die for controllably shaping and directing pressurized gas in an elongated knife-like gas jet to impinge across the width of continuously moving strip so as to pre-selectively shear excess adherent coating to produce desired coating weight and desired coating configuration (profile) across the full width dimension of the coated strip.

Use of a steam jet for hot-dip galvanizing of continuous steel strip originated with the teachings of U.S. Pat. Nos. 3,499,418 and 3,808,033; that practice supplanted use of coating rolls at the bath surface. Teachings of those patents enabled significant increases in continuous-strip galvanizing production line speeds to around 500 ft/min.

However, it has been discovered that increasing line speeds increases coating thickness in approaching lateral edges of a widely-used range of substrate widths and increases tracking and coiling problems previously associated with edge beading of coating (see U.S. Pat. Nos. 3,917,888 and 4,041,895).

The present coating control system eliminates such difficulties of prior continuous-strip jet-coating practice while achieving desired coating weight and thickness profile across the width of the substrate in continuous operations free of any requirement to interrupt operations for coating control purposes. In a specific galvanizing embodiment, edge-center-edge coating specifications are met more accurately and economically while providing for significantly enhancing tracking operations and coiling of the coated continuous strip.

BRIEF DESCRIPTION OF THE DRAWINGS

The above and other advantages and contributions are considered in more detail in describing embodiments of the invention shown in the accompanying drawings, in which:

FIG. 7 is an enlarged schematic view of an interior portion of an elongated die, along a horizontally-oriented plane in its longitudinal dimension, for describing a fixed centrally-located tubular conduit and pivotally adjustable off-center conduits providing for directional-component control within a pressurized gas jet from externally of the die;

FIG. 8 is a schematic cross-sectional view in a vertically-oriented plane at the longitudinal centerline of the elongated die of FIG. 7;

FIG. 9 is a schematic view of an interior portion of an elongated die, contiguous to its longitudinal center, and at each side thereof along its longitudinal dimension, for describing another directional-component control embodiment of the invention utilizing vane-like means which are directionally oriented from externally of the die;

FIG. 10 is a schematic cross-sectional view, in a vertically-oriented plane along the line 10—10 of the vane-like embodiment of FIG. 9 in combination with the sliding valving means of FIG. 5;

FIG. 11 is a schematic view of an interior portion of an elongated die, contiguous to its longitudinal centerline and at each side thereof along its longitudinal dimension, for describing a coacting combination of means for effecting movement of coating-control gas within a pneumatic die of the invention including angled tubular conduits, movable vanes and a centrally-located blowpipe;

FIG. 12 is a schematic cross-sectional view, in a vertically-oriented plane at the longitudinal centerline of the embodiment of FIG. 11 in combination with the sliding valving means of the type shown in FIG. 5;

FIG. 13 is a schematic view of a pneumatic die for describing directional-component effects of the pressurized gas jet as discharged from the die in accordance with the invention, and FIG. 14 is an enlarged view of a portion of the discharged gas jet of FIG. 13 for describing directional component aspects of the invention.

DESCRIPTION OF THE PREFERRED EMBODIMENTS

Prior jet coating control practice relied largely on "gap" adjustment; that is, adjustment of the discharge opening along the longitudinal dimension of the die. Gap adjustments, to be reliably accurate, require measurements to be made off-line and such coating control practice was often dependent on replacement of the dies or replacement of major portions of the dies which required interruption of coating operations.

Long-range continuity of Operations, encompassing the full range of continuous-strip products and coating specifications customarily handled on a given production line, such as a continuous-strip galvanizing line, are made practicable and readily achievable by the present invention on a commercial basis without interruption of operations for coating control purposes. Also, practice of the invention can expand the continuous coating capability range for a given line provided other line processes (cleaning, annealing of strip, etc.) can accommodate such expansion in range.

Identifying and analyzing pneumatic factors in controlling coating and coating configuration, as taught herein, increases product yield by eliminating reliance on replacement of the dies, adding of die parts, gap adjustments or the like during coating operations; and, also provides for rapid accommodation of changing products and/or preferential operating methods of individual line operators which can change from working shift to working shift on production lines operating around-the-clock.

Pneumatic control of a knife-edge gas jet is a significant contribution to providing desired coating weight and coating thickness profile across substrate width enabling desired coating weight and configuration to be maintained, notwithstanding product changes or processing preferences of differing line operators, without interruption of coating operations.

Figure 1:
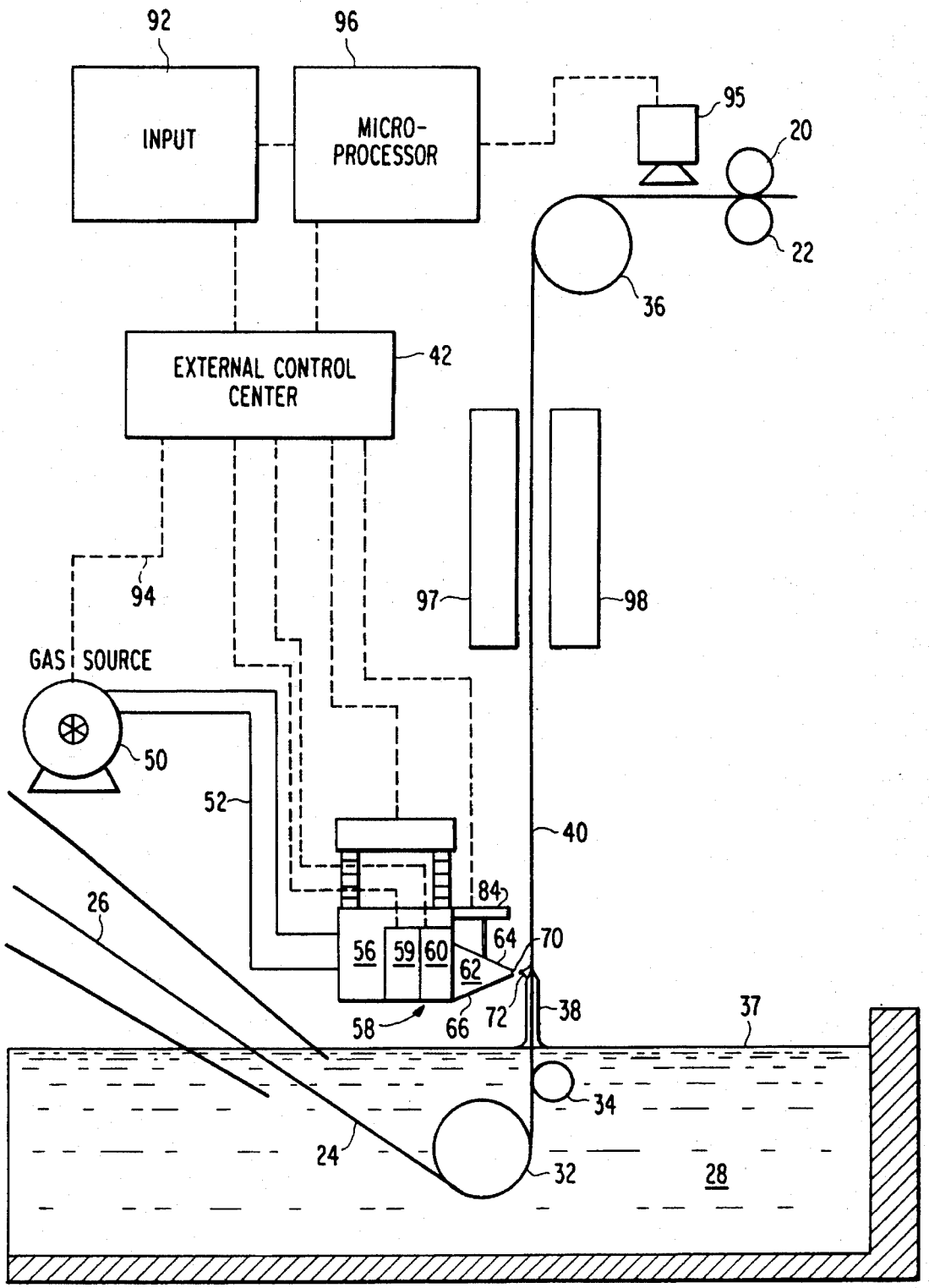
FIG. 1 is a diagrammatic general arrangement (with portions in cross section) of a flat-rolled sheet metal coating control system for modulating a gas jet and making positional and other line adjustments in a continuous-strip hot-dip metal coating embodiment of the invention.

In the continuous-strip embodiment shown schematically in FIG. 1, strip drive means 20, 22, which can be augmented by drive means at other locations in the line, move strip 24 in the direction of its length through an atmosphere-controlled chute 26, forming part of and, leading from a strip heat treatment unit into molten metal bath 28. Strip-positioning means, such as rolls 32, 34, direct the strip from the bath, and strip-support roll 36 helps to withdraw the strip moving vertically upwardly from bath surface 37. Strip 24 moves from the bath with an excess of non-solidified coating (indicated at 38 in FIGS. 1 and 2) being returned to the bath from strip 40.

Shaping and pneumatically directing a pressurized gas jet to impinge on a coated strip are important to controlling both coating weight and configuration across the width of the strip. However, in addition, other factors affecting coating are compensated for and are coordinated with gas-jet control features in control center 42 of FIG. 1.

A pair of elongated "pneumatic dies" are positioned on-line with one each operable on its respective confronted surface of the coated substrate. A knife-like gas jet is shaped and directed by each die to impinge against its respective surface of the substrate and the dies are oriented in relation to a horizontally-oriented bath surface (37 in FIG. 1) and the vertically-oriented travel path of the strip by the mechanically-activated means shown schematically in FIG. 2.

In a continuous-strip galvanizing embodiment, movement of a pneumatic die toward or away from the strip, and/or its position in relation to a horizontal reference plane, and gas pressure or other mechanical activated "line factors" complement the pneumatic controls of the dies to enhance operational advantages. Each die is movable vertically by a schematically-illustrated scissors jack arrangement 44 to control its location above a coating bath. Each die structure can be moved by horizontal positioner means 45 to control spacing between discharge of its respective gas jet and its contiguous coated surface. Each die structure can also be moved by incidence-angle adjustment means 46 for changing the angle of discharge in relation to the horizontal plane. The pair of dies are in opposed relationship but discharge of the gas jets to impinge "head-on" in the same plane is avoided for noise abatement purposes.

Referring to FIG. 1, pressurized gas from source 50 is delivered through conduit 52 into gas-inlet plenum 56 of pneumatic die 58. The die and its plenum have an elongated configuration which can be coextensive; and, the elongated die discharge is dimensionally greater than the width of any strip to be handled on a given production line. The elongated die is preferably oriented with its longitudinal dimension substantially horizontal and symmetrical with respect to the centerline of the travel path of the strip as the latter moves vertically in the direction of its length.

The shape of the discharge outlet of the pneumatic die is narrow in the direction of substrate travel. Present teachings enable that gap opening to be pre-determinedly established along the length of the outlet prior to placement of the die on-line and enable that gap to remain fixed throughout the range of products normally produced on such line. Each gas jet, discharged along the full length of its respective die discharge outlet, impinges against the substrate surface confronted. The gas jet has a substantially planar knife-like configuration for use with substantially planar strip. The amount of coating remaining on the substrate is controlled by a "shearing" action of the gas jet which removes excess coating above a desired coating weight or thickness as the substrate travels vertically upwardly from the bath.

Shaping and controlling the emerging gas jet are provided by quantitative and/or directional-component gas flow control means mounted internally of the pneumatic die; and, such internally-mounted control means are made adjustable from externally of each die. As the coating-control gas moves through a die from its gas-inlet plenum toward its discharge outlet, the pressurized gas is selectively regulated quantitatively along the length of the die by means 59 (shown diagrammatically in FIG. 1); and, directional-component control means (shown diagrammatically at 60 in FIG. 1) selectively control directional components of the knife-like gas jet.

The quantitative and/or directional-component control means within the die are independently adjustable on-line utilizing means which are accessible from externally of each die during coating operations without removing the die from the line or adding parts thereto or changing the discharge opening gap. In a preferred practice, such internal controls are selected and established for desired coating profile. On a given line, the internal adjustments for desired profile control can then be maintained throughout the range of products of that line; and, coating weight adjustments, as may be required for differing products of that line, are made by relying largely on the "line factors" mentioned above.

Nozzle chamber 62 is located, as seen in the vertical cross section of die 58 in FIG. 1, between the gas-inlet plenum and the discharge outlet for the die 58. The nozzle chamber 62 extends along the elongated dimension of the die; and, preferably, is longitudinally coextensive with elongated gas-inlet plenum 56. As shown by FIG. 1, the nozzle chamber 62 is largely defined by the interior surfaces of nozzle elements 64, 66 which decrease the vertical cross-sectional flow path of chamber 62 in approaching nozzle discharge outlet 70.

Vertical spacing (gap) between the internal lip surfaces of the discharge outlet portions of nozzle elements 64, 66 defines an elongated, narrow-width gas discharge outlet 70. The velocity (force) of the coating-control gas further increases in such narrow width discharge outlet just as the velocity of the gas has been increasing during movement from a near static condition in the gas-inlet plenum through the decreasing cross section of the nozzle chamber. The internally-mounted means for pneumatic control previously mentioned help to establish the dynamic conditions for the gas discharge which reaches its highest velocity and force as discharged at outlet 70.

Figure 2:
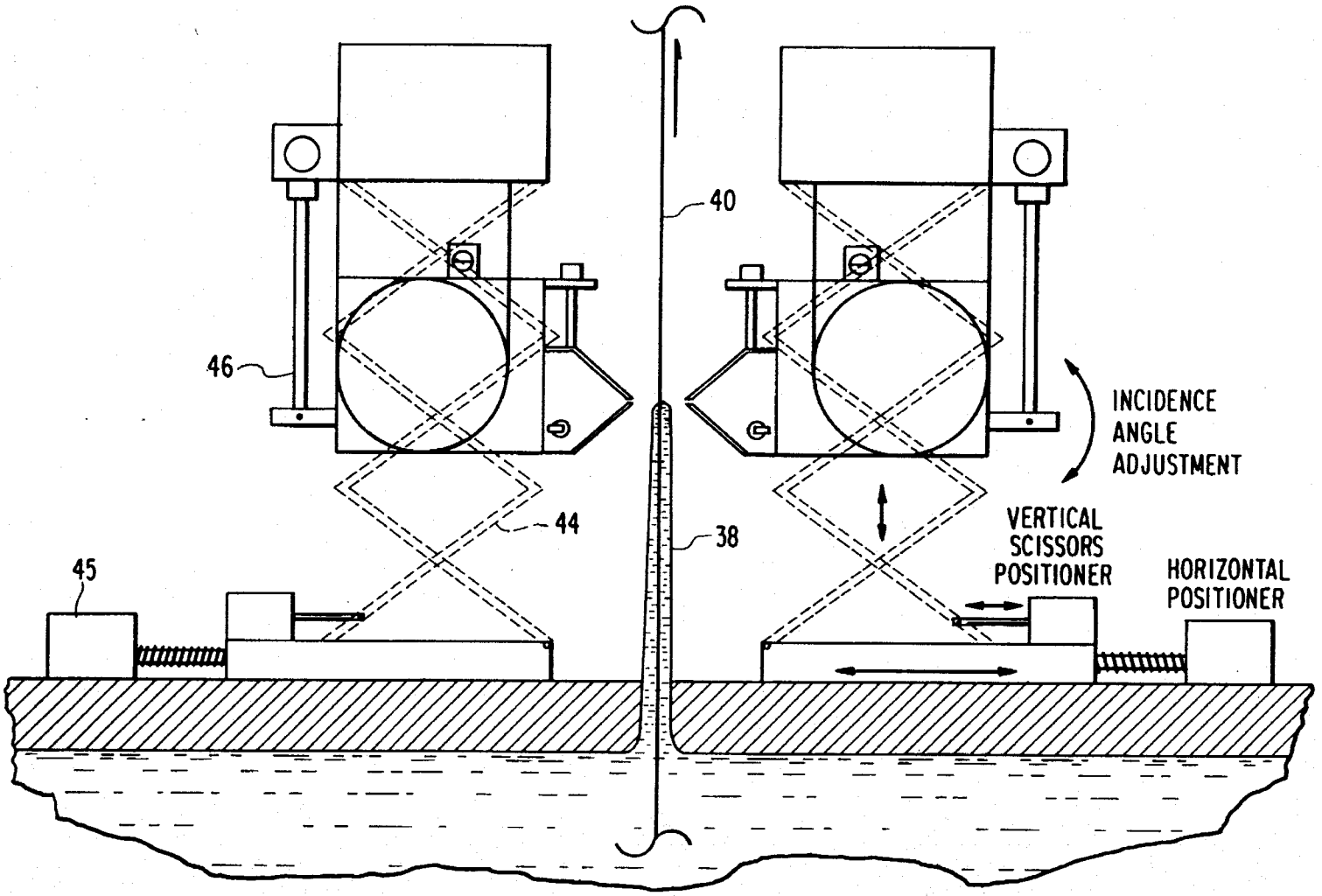
FIG. 2 is a schematic view, partially in cross section, of a pair of pneumatic die structures which include positioning means for use in the coating control system of FIG. 1.

In the embodiment of FIG. 2, jet 72 impinges with its major directional component of force (and velocity) oriented substantially horizontally and perpendicularly transverse to the travel plane across the full width of the coated strip. Jet 72 has a shearing action which decreases the amount of coating remaining to a preselected desired level which is carried upwardly on the strip for solidification beyond the region of impingement.

The configuration of discharge outlet 70 is preadjusted and established before placement of the dies in a given production line for continuous operation. The externally-accessible controls for the internally-mounted means can be adjusted, as necessary, to maintain desired coating weight and/or coating configuration across the width of the strip; but, such externally-accessible adjustments are preferably made before start of operations. For example, it has been found that, with the teachings of the present invention the control of coating profile provided by the internally mounted means is effective through the full range of products customarily handled by a given line; and, that changes in desired coating weight for differing production products, or accommodating differing operator methods, for a given line can be handled by the gas pressure supplied or the mechanically-activated line factors as mentioned above.

The die structure support and positioning means made available (FIG. 2) facilitate selection of differing die orientations and positional relationships (above the bath, spacing from strip, etc.) as may be preferred by differing line operators and/or to augment the pneumatic die controls. Control center 42 (FIG. 1) coordinates and interrelates selected valves of the die control means, the coating gas pressure, positional, sensory and/or calculated data to facilitate selections of control factors by providing guidance for selections which maintain desired coating and configuration under changing conditions and/or changing products; control center 42 can also be used to provide a complete record of operating data.

Embodiments of internally-mounted flow and directional-component means with externally-accessible controls are shown in more detail in FIGS. 4 through 12. The pressurized coating-control gas is modulated quantitatively and directionally along the length of the die during its movement from the gas-inlet plenum toward the discharge outlet. In the valving means embodiment of FIGS. 3 and 4, an internally-mounted valve plate (indicated as 74 in FIG. 4) extends longitudinally of the die and is controlled by a series of valve stems (such as 75 in FIG. 4). Such valve stems are operable horizontally to control the opening from the gas inlet plenum into the nozzle chamber along the length of the valve plate. Externally accessible movement control means, such as 76, 77 and 78 (FIG. 3) are provided for each valve stem to select valve plate opening along its longitudinal dimension.

Figure 3:
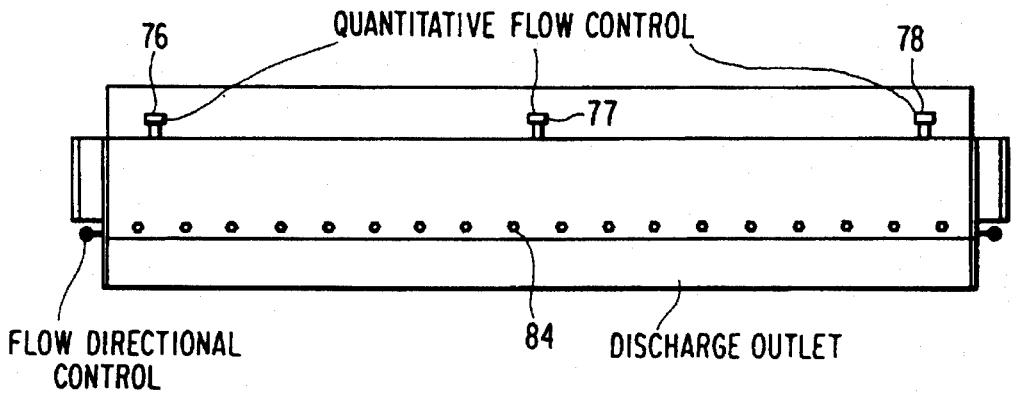
FIG. 3 is a top plan view of an elongated pneumatic die of the invention showing a portion of the externally-mounted means for adjustment of discharge of a pressurized gas jet to impinge across the width of a coated sheet metal surface.
Figure 4:
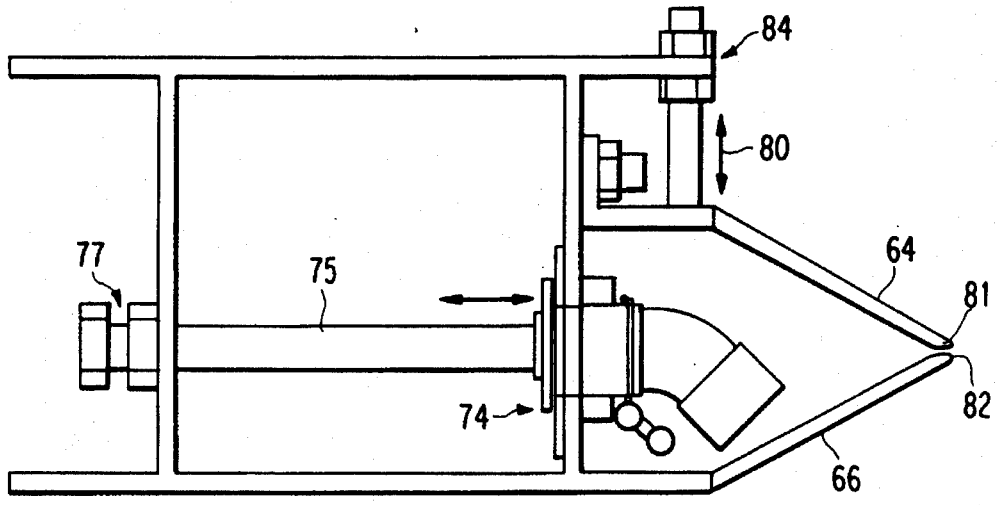
FIG. 4 is a schematic cross-sectional view, in a vertically-oriented plane which is transverse to the longitudinal dimension of the elongated die, for describing a specific embodiment of valving means within the pneumatic die of FIG. 3.

Vertical movement of nozzle element 64, as indicated by arrow 80 (FIG. 4), determines the gap between lip portions 81, 82 of nozzle elements 64, 66 respectively. Gap adjustment along the length of the die can be made by means of adjustment means 84 as shown in FIG. 4. A plurality of such adjustment means are distributed along the longitudinal dimension of the die as shown in FIG. 3. An advantage of the invention is that gap opening along die length can be preset and fixed as described earlier; however, clearly mechanization is readily achievable for remote control of gap opening through a control center such as 42.

Figure 5:
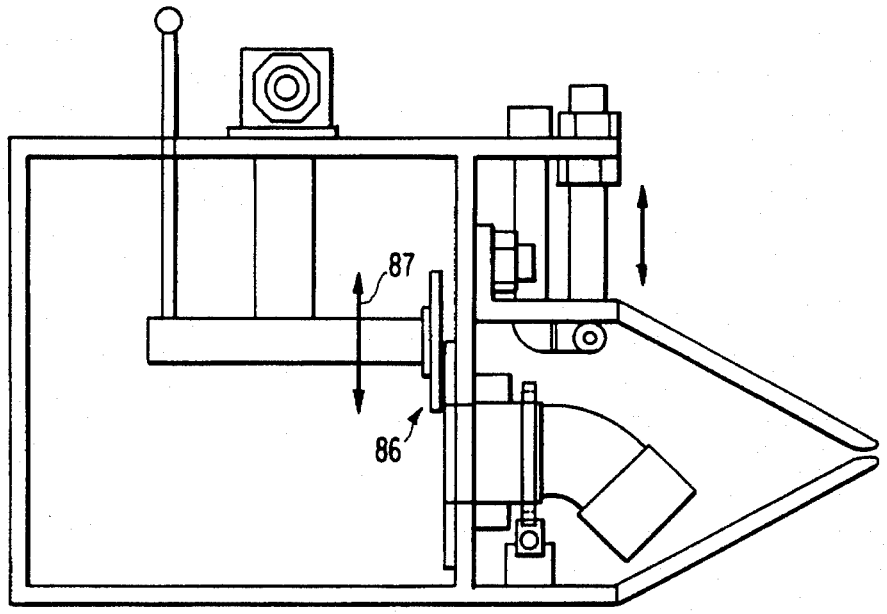
FIG. 5 is a schematic cross-sectional view, in a vertically-oriented plane which is transverse to the longitudinal dimension of an elongated die, for describing another valving means embodiment of the invention.
Figure 6:
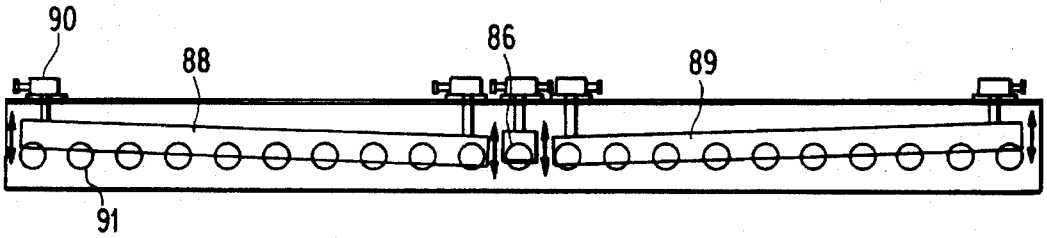
FIG. 6 is a schematic view along the longitudinal dimension of an elongated die for describing operation of internally-mounted valving means and externally-mounted valving-adjustment control means of FIG. 5.

FIGS. 5 and 6 show another embodiment of the valving means in which slidable valve plate means 86 move vertically as indicated at arrow 87 in FIG. 5. As shown in the elevational view of FIG. 6, a plurality of slidable valve plates 86, 88 and 89 are provided in the specific embodiment. Valve plate 86 is centrally located and is discussed in more detail later. Valve plates 88 and 89 (which can be further subdivided) exercise quantitative control of gas movement selectively along the longitudinal dimension of the die from adjacent to its longitudinal central portion toward each longitudinal end. Selected vertical movement of the valve plates 88 and 89, as indicated in FIG. 6, is provided through externally-mounted mechanized control means (such as that designated at 90) at each end of each plate. Such vertical adjustment determines gas passage through openings such as 91. The vertical-movement of the valve plates 88, 89 at each of their respective ends provides for selective opening of passages along the longitudinal dimension of the die on each side of center valve plate 86. The latter can be utilized to quantitatively effect gas impingement centrally of the moving strip.

Control means 60 of FIG. 1 diagrammatically represent directional-component control of the gas exercised within the die along its longitudinal dimension. As taught herein, the major or primary directional component (for coating control purposes) of the discharge outlet jet is horizontally-oriented and perpendicularly transverse to the travel plane of the substrate across its width; in addition, however, a minor or secondary directional component is selectively introduced in a manner so as to be capable of acting from a centrally located portion of the die in the direction of each longitudinal end of the die.

Directional-component control is introduced to control the profile and, more specifically, to minimize or eliminate the increase in coating thickness on the strip previously experienced as spacing from the centerline of the strip increases in approaching lateral edges of the strip; such directional-component control also eliminates edge beading and streamers on the strip. The minor directional component or "vector" is preferably exercised symmetrically in relation to the longitudinal center of the die and the substrate; but, can be otherwise as may be required by substrate characteristics or coated product specifications.

Such minor directional component is introduced within the substantially planar gas jet as discharged from the pneumatic die. At a plurality of locations along the longitudinal dimension, a minor directional vector toward its respective end of the die, and lateral edge of the substrate is introduced. The major directional component of gas velocity and force of gas jet 72 is perpendicularly transverse to the plane of the strip across its width. Typically, no minor directional component is introduced at the center of the die.

Two representative means located with a die for effecting directional-component comprise angled tubular conduits and vane-like elements; they can be used separately or in concert. Preferably, each is at least coextensive with the longitudinal dimension of the die and/or at least coextensive with the quantitative control valving means discussed earlier. In a representative embodiment a minor directional-component is introduced at each location of such means along the length of the die.

For elimination of edge build-up and related problems on both edges, the minor vector is directed symmetrically (with respect to the longitudinal centerline of the strip) toward each lateral edge. Such minor directional component input toward each lateral edge of the strip can be adjusted gradually along the longitudinal dimension.

The perpendicularly transverse velocity and force (major) component of the gas jet impinges across the full width of the strip. However, the minor directional component which is at right angles to the major component, and on each side of the longitudinal center is directed toward its respective longitudinal end, has additive characteristics as it is introduced at distinct locations spaced in each such direction.

Such additive characteristics make the minor directional component increasingly effective in approaching each lateral edge of the strip thus preventing increases in coating thickness in approaching each edge and eliminating edge beading. However, the magnitude of the major component of force and velocity at individual locations along the longitudinal dimension remains substantially uniform and is not substantially diminished by rotatably-mounted tubular conduits (pipe elbows) which are substantially uniformly angled along their respective axes as best seen in FIG. 7, nor by substantially uniform vane means as best seen in FIG. 9, nor by such vane means acting between and in concert with such angled tubular conduits as best seen in FIG. 11.

The vane means help to subdivide compartments along the longitudinal dimension of the nozzle chamber for more effective incremental directional control. Individual or groups of conduits and/or vanes can be moved selectively from externally of the die. In general, the centrally-located tubular conduit is fixed and the adjacent vane(s) on each side can be similarly used. The angled tubular conduits extend into the nozzle chamber 62 from the gas inlet plenum 56 and are peripherally distributed uniformly along the longitudinal dimension toward each end.

In general, it is preferred to establish a minor directional vector toward each end along the length dimension within the pneumatic die. A gradual additive effect within the jet along such length dimension avoids striations or streaking in the coating. Such introduction of minor directional components toward each longitudinal end of the die prevents the previously-described increasing thickness problem. Such incremental minor directional components can be introduced starting with a location contiguous to, or selectively spaced from, the center of the longitudinal-dimension of the die which is also the longitudinal center of strip travel, and extend toward each lateral edge of the strip. With strip which is flat across its width, such minor angled directional-component control can be directed symmetrically toward each lateral edge and the additive characteristics, eliminate such increasing thickness, edge buildup and related edge problems while helping to maintain desired uniformity of coating in a consistent manner.

Adjustments affecting pressurized gas movement internally of the die can be performed on-line to increase the range of products handled on a given line while avoiding any requirement to substitute dies or change discharge openings. In general, however, once established, further adjustments of the internally-mounted control means are not required for product changes (gage, width, etc.) for which a given line was designed. That is, establishing such internally-mounted means to achieve desired profile and/or uniformity is a contribution which extends substantially throughout the range of products on a given line while relying on gas pressure or die positioning factors for increasing or decreasing coating weight. For example, the pressure of the coating control gas supplied to gas-inlet plenum 56 can be adjusted through signal control line 94 (FIG. 1) to increase or decrease coating weight which is being maintained with the desired profile, or uniformity, by the internal control means. Positioning of each pneumatic die structure to vary the distance between the surface of the bath and its discharge outlet or for varying the distance between the discharge outlet and the strip surface, or other die orientation or positional adjustments can be carried out through control center 42 so as to interrelate coacting effects. The coating-control gas pressure, positional aspects of the die structures, as well as "crown control" features to be further described later, can be selected and/or interrelated through control center 42.

Non-destructive testing for coating weight and configuration after coating solidification is facilitated without altering the normal strip travel path. Present teachings enable earlier measurement and control so as to increase product yield. On-line sensing in closer proximity to the coating bath is facilitated by faster cooling; for example, non-destructive testing can take place contiguous to top roll 36 (FIG. 1). Sensing means 95 are positioned to provide for the shortest time lag practicable between coating and sensing of solidified coating. The output of the sensing means is directed through microprocessor 96 to control center 42 for responsive adjustment, priority in selecting adjustment means being programmed based on pre-established interrelation of control means mounted within the dies and/or adjusting die orientation or gas pressure supplied to the dies.

Forced heat removal, after coating control, is augmented by atomizing a coolant with a high heat of vaporization (such as water) and directing the atomized coolant against at least one substrate surface. Preferably, the coolant is not used to alter any desired grain structure in the coating e.g. by application prematurely to the coating. The heat of vaporization of the atomized coolant rapidly removes heat to enable closer placement of sensor 95 (FIG. 1) to the coating control stage than would otherwise be practical. Prompt pneumatic die adjustments and/or die positioning or gas pressure adjustments can thus be carried out promptly taking corrective measures stemming, for example, from substrate changes or from operator preferences so as to increase satisfactory product yield.

Computer-assisted coating control factors can be more readily interrelated with microprocessor means 96 (FIG. 1) performing as a programmable logic controller (PLC). The microprocessor receives signal data covering sensory and other system inputs from the control center 42 and is programmed to select a preferred adjustment or combination of adjustments for optimum results, including adjusting the gas jet and/or gas pressure or die orientation to establish or maintain the desired coating weight and/or coating profile.

The internally-mounted directional-component elements in the embodiment of FIG. 7 include a plurality of angled tubular flow conduits such as 100, 101, 102,103 extending (in a vertical transverse plane as shown in FIG. 8) from the previously described gas inlet plenum into the nozzle chamber. Such angled conduits are pivotally mounted and can be rotated, for example, by rack and pinion drive means, shown schematically at 104. The rack portion moves in the direction(s) indicated at 105 to introduce the desired angle with each conduit introducing its minor directional vector into movement of the coating-control gas.

The centerline cross section of FIG. 8 shows a centrally-located conduit 106 which is fixed (not pivotable). Such an embodiment initiates a unique crown-control feature of the invention acting contiguous to the center of the die. A specific embodiment for improving crown control comprises blowpipe gas means with outlets such as 92 (FIGS. 8 and 9) which direct blowpipe gas away from such central portion of the die to diminish the impinging pressure of the coating-control gas so as to increase coating thickness along the centerline of travel of the strip; such crown control facilitates desired tracking and coiling of coated stock.

Referring to FIG. 9, movable vanes such as 107, 108 109, 110 and 111 can be moved from externally of the die in a single coordinated movement through use of an interconnecting arm 112 in directions indicated at 114; or, in the alternative, connections can be provided for movement of individual vanes or movement of vanes in subdivided groups. Also, the vanes can include an aperture or apertures as defined by circular lines 108, 112 and 115 of FIG. 10; such apertures assist in graduating the effect of directional-component compartments and control.

FIGS. 5, 11 and 12 show means for effecting quantitative movement of coating-control gas movement within the die toward the discharge outlet along with a combination of means for directional-component control. In FIG. 11, the angled tubular conduits, such as 110, can be fixed as spaced along the longitudinal dimension of the die with the vanes, such as 114, being movable as indicated at 115. The vertically slidable valve plate means 86 (FIG. 12) is moved by actuating means 116, with the location on the vertically slidable valve plate being displayed and readily discernable from externally of the die by individual indicators such as 117 which are distributed along the longitudinal dimension of each valve plate support.

Quantitative flow and directional component control are introduced along the longitudinal dimension of the die on each side of centerline C/L of FIG. 11. The above-described means can eliminate coating thickness profile problems and edge beading problems which previously distorted tracking and coiling. However, to further improve tracking and coiling characteristics, the invention introduces a pneumatic crown control method and apparatus. Blowpipe gas means 97 (FIG. 11) outlet 92 (FIG. 12) can be combined with the internal control means described in relation to each of the embodiments of FIGS. 4–12. Centrally-located blowpipe gas outlets pneumatically provide for crown control centrally of the strip which decreases or eliminates the tracking or coiling problems associated with previously available coating profiles.

"Crown control" as referred to herein for continuous strip galvanizing is concerned with establishing and maintaining an extremely thin (about 0.06 to 0.08 ounce per square foot) increase in coating thickness centrally of the strip. Such crown control is particularly helpful at lower line speeds and when coating narrow strip products (approaching and below 36" width). The centrally-located pneumatic crown control can be used to supplant and/or augment initiation of crown control by the fixed centrally-located quantitative control means described earlier.

Discharge of blowpipe gas diminishes the pressure force of the coating control jet centrally of the strip and helps to provide a desired minimal increase in coating thickness as taught herein.

The blowpipe gas outlets (such as 92) are contiguous to the center of the die as shown. The blowpipe is supplied with a gas at a pressure in excess of the pressure of the coating-control gas at the location of the blowpipe outlets which is contiguous to the discharge outlet. The blowpipe gas source can be a higher pressure supply of a coating-control gas e.g. nitrogen or other inert gas, or carbon dioxide; or, can be compressed air provided and controlled at the coating site.

The blowpipe outlets discharge blowpipe gas from contiguous to the center of the die toward at least one longitudinal end of the die;- but, preferably, uniformly toward both longitudinal ends, along a direction which is substantially parallel to the longitudinal dimension of the discharge outlet. Such blowpipe gas movement, being of higher pressure and higher density than the lower pressure coating-control gas, acts to drag a portion of the coating-control gas from the center of the die toward each longitudinal end of the die. That diminishes the pressure of coating-control gas centrally of the travel path of the strip; e.g. at about 5% of the strip width on either side of, and contiguous to, the centerline of travel of the strip.

The "crown control" increase in coating thickness as taught herein is kept minimal because of the number of laps in a coil; for example, galvanized steel coils have about 180 to about 1400 laps. The blowpipe gas outlet pressure can be accurately and readily varied to accurately augment and maintain desired crown control.

Electric motors, e.g. in a selsyn system, can readily be used for remote actuation and readily controlled to adjust the internally-mounted means for controlling gas movement within the die or for orientation and position of the dies or control of gas pressures; these factors can be readily modulated and correlated through control center 42 and by other means as well.

Notwithstanding the various strip products (gage, width, etc.) handled by a given production line, or the various line speeds or coating specifications to be encountered, gap selection is preferably preset along the longitudinal dimension of the discharge opening before start of coating operations and predeterminedly established for long-term continuous coating operations. One of the significant contributions of the invention is that the gap can remain fixed during such operations of a given line because of the functions and effectiveness of the previously-described internal controls in maintaining desired coating and profile relationships across a wide range of product specifications. Thus, long-term continuous operations need not be interrupted for coating control purposes as in the prior art. Continuous strip galvanizing production lines, for example, would generally be interrupted on a periodical basis such as once a month for other purposes such as line maintenance procedures.

The directional component teachings of the invention can be better described in relation to FIGS. 13, 14. A symmetrical pattern of discharge is illustrated in FIG. 13. The vector for the major directional component is relatively uniform across the width of the strip in such a symmetrical pattern. The minor directional component vector is at substantially right angled relationship to the perpendicularly-transverse major directional component and eliminates problems as previously described. It should be recognized that while the pattern of discharge would preferably be symmetrical on each side of the center, as illustrated in FIG. 13 variations thereof can be readily accomplished by the internally-mounted directional-component control elements distributed longitudinally as previously described. Also, combining vector analysis of FIG. 14 with the discharge pattern of FIG. 13, demonstrates the cumulative effect of the minor component vectors toward each lateral edge of the strip.

It has been found that the outlet pattern of the perpendicularly transverse major component of the pneumatic jet velocity or force (as depicted by FIGS. 13, 14) is not significantly affected by introducing the pressurized coating-control gas from either or both longitudinal ends of the gas inlet plenum. That is, symmetry of gas distribution is readily accomplished within the gas plenum and nozzle chamber along the longitudinal dimension of the die by relying on the internal configurations and gas movement principles taught herein. Therefore, gas from either or both plenum inlets (118, 119 of FIG. 13) is distributed substantially uniformly along the longitudinal dimension of the elongated die due to the volume of the gas-inlet plenum, and the gas movement controls within the die. Gas inlet pressure can be selected dependent on the blower system available at the site; in the continuous steel strip galvanizing embodiment set forth herein, the gas can be from a source having a pressure from about one (1) PSIG to around seven and one half (7.5) PSIG. For purposes of the invention, the coating control gas can comprise inactive gases such as carbon dioxide, or neutral gases such as nitrogen, or mixtures of inactive and neutral gases or mixtures with air; and, the temperature of such gas can be controlled in relation to the coating metal temperature.

The discharge opening is defined by nozzle lips defining a unitary smooth surface to avoid striations in the coating due to interruptions in nozzle lip surfaces. For example, each of the nozzle elements (64, 66, FIG.1) presents a nozzle lip surface which preferably is unitary along its length. The gap (vertical dimension between the lips) can be established by moving both the upper and lower lip-forming elements but, preferably, the gap is adjusted incrementally along the die length by vertical movement (in the vertical cross section shown in FIG. 4) of nozzle element 64 which presents the upper lip. Gap adjustment means 84 shown in detail in FIG. 4 are distributed as shown in FIG. 3 along the length of the die to provide for graduated change in discharge opening along the length of the die. As has been pointed out, the selected gap is, preferably, predeterminedly fixed for the differing product operations of a given production line for long-term coating operations of that production line.

The unitary feature of each lip surface avoids flow turbulence across the strip which can be experienced when lip members are segmented along their longitudinal dimension. Also, striations in surface coating are avoided by use of the graduated internal adjustments provided along the longitudinal dimension of a die in accordance with previously presented teachings. Further, the "T" shaped blowpipe outlet arrangement is such that the controlled crown effect can be gradually and finely tapered from centrally of the strip toward each side edge of the strip.

In a specific embodiment of a pneumatic die such as shown in FIG. 4, the vertical cross section die structure shown can be defined by flange and web members of structural steel beams.

Dimensions and values for a steel strip galvanizing line embodiment and operation thereof are as follows:

| | |
|---|---|
| Coating-control gas | |
| pressure range | 1 to around 7.5 PSIG |
| Gas-inlet plenum | |
| cross section | 5½ × 5½" |
| length | 70" |
| Nozzle chamber | |
| cross sectional height | 3½" |
| width from plenum wall to discharge outlet lips | 5½" |
| Typical tubular | |
| conduit diameter | 1" |
| Blowpipe gas | |
| pressure range | about 2.5 to about 10.0 PSIG |
| Gap opening | 0.030" to 0.1250" |

The tubular conduits for a steel galvanizing embodiment can comprise elbows of selected diameter, for example, about one to two inches. Each conduit is machined to fit within an assembly providing for rotational adjustment (swiveling) of angled conduits, either individually or in groups, from externally of the die. The conduits can be directed vertically downwardly when not in use for minor directional component control as indicated by the vertically-oriented cross sectional centerline view of FIG. 8 since such "downward" orientation of a conduit produces no angled minor component of direction in the discharged jet at such location.

The gap is preferably preset across the full nozzle opening off-line and accurately measured for long-term operations. In the steel galvanizing embodiment of FIG. 5, a central gap of 0.060" may gradually open toward each longitudinal end to a gap of 0.080". A more uniform gap along the length of the discharge opening is achievable with the internally-mounted quantitative, flow directional controls and blowpipe gas-outlet means of the embodiment of FIG. 11.

The vertical movement for a plate valve as described in relation to FIGS. 5 and 12 has the advantage that the movement of the gas from the plenum toward the nozzle chamber tends to hold the vertically sliding plate against valve opening structure to provide better control and avoid valve plate vibration. The vertical movement embodiment, shown schematically in FIG. 6, utilizes a vertical movement actuator on each longitudinal end of the two elongated valve plates and centrally located ends.

Trial-run data verifies that the pre-selection of the gap and other die aspects extends profile control throughout the range of a given production line and results in increased yield within specifications and other economic advantages such as decreasing cumulative coating metal requirements; see tabulated data below.

| Continuous Steel Strip Galvanizing Line Trials | |
|---|---|
| Substrate Gage | .029–.160 |
| Width | 24"–48" |
| Range of Line Speeds | 50 to 250 feet per minute |
| Coating Specs | 0.3–2.75 oz per sq. ft. |
| Product Use | Construction-Hardware Service Center Stock |
| Profile | Decreased coil rejections due to spooling, coating striations |
| Streamers Improvement | Edge beading and streamers eliminated |
| Coating Differential Improvements | Edge-center-edge differential decreased by an average of 22% over the range of coating weights previously available. |

While specific data has been set forth in describing the invention, it should be recognized that the above teachings could be used to devise embodiments other than those specifically described; therefore, in determining the scope of the present invention, reference shall be had to the appended claims.

We claim:

1. Continuous-strip hot-dip metal coating process for controlling molten metal coating remaining on flat-rolled steel continuous strip, comprising A. passing flat-rolled steel continuous strip in the direction of its length while submerged in a hot-dip molten metal coating bath, B. withdrawing such strip upwardly from such bath with an excess of molten coating adhering to each surface thereof, C. controlling the travel path of the strip so as to pass in spaced relationship between a pair of pneumatic dies for pneumatically controlling non-solidified molten metal coating remaining on each substrate surface, by shaping and controllably discharging a pressurized gas jet, each of such pair of dies being supported in confronting relationship with a single coated surface, with the dies being at or near opposed relationship on opposite sides of such moving strip with each discharging its respective gas jet in substantially perpendicular relationship to the plane of travel of such strip as passed in such spaced relationship between such confronting pair of dies;

D. orienting each elongated pneumatic die with the center of its longitudinal dimension at approximately the center of width of such strip and with the longitudinal dimension of each such die extending to lateral edges of the elongated strip across its full width, each such die including:

(i) chamber means extending along its longitudinal dimension for receiving coating-control gas under pressure for movement within the die toward such confronted coated surface, (ii) a nozzle discharge outlet extending along such longitudinal dimension in substantially symmetrical relationship across such strip width, such discharge outlet having a pre-established cross-sectional configuration which is narrow in the direction in which the strip is moving so as to shape and discharge each such pressurized gas jet in a generally-planar configuration, and (iii) means located internally of each such die for establishing a primary directional component of gas movement within such generally-planar configuration pressurized gas jet which is substantially perpendicular to such confronted surface, and including internally-located means, which are variably-adjustable by means located externally of such die, along such longitudinal dimension for introducing a secondary directional component in angled relationship to such primary directional component within such generally-planar configuration gas jet discharged from such die;

D. controlling such pressurized gas jet as discharged from such die to impinge against its respective coated surface so as to shear excess non-solidified coating from that surface, and E. controlling such secondary directional component of gas movement within such pressurized gas jet to control coating thickness profile across such strip width surface.

2. The process of claim 1, in which such secondary directional component of gas movement within each such pressurized gas jet is controlled to be in angled relationship to such primary directional component so as to selectively direct a portion of each such pressurized gas jet, on each lateral side of such longitudinal center of each such elongated die toward such lateral edge of the strip on its respective surface, as such strip travels upwardly in the direction of its length toward a coating solidification zone.

3. The process of claim 2, further including:

controlling coating weight across strip width by selecting from the group consisting of:

A. adjusting the spacing of each pneumatic die discharge outlet above such hot-dip molten metal bath surface, B. adjusting the orientation of, and spacing between, each such die discharge outlet and its respective strip coated surface, C. adjusting gas pressure as supplied to each pneumatic die, and D. combinations thereof.

4. Process for controlling non-solidified galvanize coating remaining on flat-rolled steel continuous strip of predetermined width extending between lateral edges of such strip while moving in the direction of its length, comprising A. delivering such strip in the direction of its length with an excess of non-solidified galvanize coating adhering to each surface across such predetermined strip width, B. controlling the travel path of the strip so as to move substantially vertically upwardly in relation to a pair of pneumatic dies, each for shaping and controllable discharging a pressurized gas jet, C. supporting such dies to position one each of such pair in confronting relationship with a single coated surface of the strip symmetrically across such predetermined strip width, with the dies being at or near opposed relationship on opposite sides of the moving strip with each discharging its respective gas jet in substantially planar perpendicular relationship toward its confronted surface between lateral edges of such elongated strip across its full width, and D. providing each elongated pneumatic die with internally-located means which are variably-adjustable by means mounted externally of such die, such variably-adjustable internally-located means being located along the longitudinal dimension of each such die so as to:

(a) direct such pressurized gas toward such confronted surface, across such predetermined strip width, with a primary directional component which is in substantially perpendicular relationship to such strip, and (b) selectively control a secondary directional component of gas movement within such pressurized gas jet as discharged from each such die, with such secondary directional component being directed in angled relationship to such primary directional component of gas movement within such jet, so as to provide for pneumatically controlling the thickness profile of non-solidified galvanize coating remaining on each such confronted coated surface.

5. The process of claim 4, in which each such elongated pneumatic die includes:

(i) chamber means extending along its longitudinal dimension for receiving coating-control gas under pressure and for directing movement of such gas, under uniform pressure across such longitudinal dimension within each die, toward such single coated surface, (ii) a nozzle discharge outlet extending, coextensive with such chamber means along such longitudinal dimension of such die, in substantially symmetrical relationship across such confronted strip width, such discharge outlet presenting a pre-established cross-sectional configuration, which is narrow in the direction of strip travel, so as to shape and discharge each such pressurized gas jet in such generally-planar configuration, and selectively controlling such secondary directional component of gas movement within such pressurized gas jet so as to be directed from such longitudinal centerline of such predetermined width strip toward each of its lateral edges to prevent edge buildup of molten coating metal on each such lateral edge of such strip.

6. The process of claim 5, further including valving means located internally of such die along its full longitudinal dimension to quantitatively control movement of pressurized gas toward such outlet means, and in which such variable adjustment means, for controlling such secondary directional component of gas movement within each die, is selected from the group consisting of:

(i) a plurality of conduits each defining a tubular flow path toward the discharge outlet with at least a portion of the tubular flow paths having an angled orientation for effecting such secondary directional component of gas movement from centrally of such die toward each respective lateral edge of such elongated strip, (ii) blowpipe gas outlet means located centrally of such longitudinal die dimension for discharging a second gas at a pressure in excess of the coating-control gas pressure within such die toward each lateral edge of such elongated die, in substantially perpendicular relationship to such primary directional component of movement of such pressurized gas jet, and (iii) combinations thereof.

7. The process of claim 6, including selecting such blowpipe gas outlet means, and further including controlling such discharge of a second gas within such die to provide for slightly increased-thickness galvanize coating along such centerline of the strip.

* * * * *